US005644958A

United States Patent [19]

Roberts et al.

[11] Patent Number: 5,644,958

[45] Date of Patent: Jul. 8, 1997

[54] QUICK RELEASE MECHANISM FOR TOOLS SUCH AS SOCKET WRENCHES

[75] Inventors: Peter M. Roberts, Chattanooga, Tenn.; C. Robert Moon, Joliet, Ill.

[73] Assignee: Roberts Tool International (USA), Inc., Chicago, Ill.

[21] Appl. No.: 284,387

[22] Filed: Aug. 2, 1994

Related U.S. Application Data

[63] Continuation-in-part of Ser. No. 50,514, Apr. 20, 1993, which is a continuation-in-part of Ser. No. 959,215, Oct. 9, 1992, Pat. No. 5,233,892.

[51] Int. Cl.[6] ..... B25B 23/16

[52] U.S. Cl. ..... 81/177.8; 403/322; 279/82

[58] Field of Search ..... 81/177.2, 177.85; 279/82, 86, 93, 94; 403/327, 324, 325, 328

[56] References Cited

U.S. PATENT DOCUMENTS

| | | |
|---|---|---|
| 1,569,117 | 1/1926 | Carpenter . |
| 1,660,989 | 2/1928 | Carpenter . |
| 1,775,402 | 9/1930 | Mandl . |
| 1,864,466 | 6/1932 | Peterson . |
| 2,072,463 | 3/1937 | Mims . |
| 2,108,866 | 2/1938 | Mandl . |
| 2,721,090 | 10/1955 | Kaman . |
| 2,736,562 | 2/1956 | Blackburn . |
| 3,011,794 | 12/1961 | Vaughn . |
| 3,018,866 | 1/1962 | Elliott et al. . |
| 3,069,945 | 12/1962 | Shandel . |
| 3,094,344 | 6/1963 | Varga . |
| 3,156,479 | 11/1964 | Drazick . |
| 3,167,338 | 1/1965 | Troike . |
| 3,208,318 | 9/1965 | Roberts . |
| 3,515,399 | 6/1970 | Wordsworth . |
| 3,613,221 | 10/1971 | Pronk . |
| 3,777,596 | 12/1973 | Smyers, Jr. et al. . |
| 3,822,074 | 7/1974 | Welcker . |
| 3,890,051 | 6/1975 | Biek . |
| 4,367,663 | 1/1983 | Merics . |
| 4,399,722 | 8/1983 | Sardo, Jr. . |
| 4,420,995 | 12/1983 | Roberts . |
| 4,480,511 | 11/1984 | Nickipuck . |
| 4,508,005 | 4/1985 | Herman et al. . |
| 4,571,113 | 2/1986 | Coren . |
| 4,848,196 | 7/1989 | Roberts . |
| 5,233,892 | 8/1993 | Roberts . |

FOREIGN PATENT DOCUMENTS

| | | |
|---|---|---|
| 0066710 | 12/1982 | European Pat. Off. . |
| 847209 | 10/1939 | France . |
| 2121316 | 9/1972 | Germany . |

*Primary Examiner*—James G. Smith
*Attorney, Agent, or Firm*—Brinks Hofer Gilson & Lione

[57] ABSTRACT

A tool of the type having a drive stud for receiving and releasing a tool attachment includes an opening in the drive stud and a locking pin movably mounted in the opening. The opening defines upper and lower ends, and the lower end of the opening is located at a portion of the drive stud constructed for insertion into the tool attachment. An actuating member is movably positioned on the drive stud, and the actuating member defines a sliding surface oriented transversely to the pin to engage an upper end of the pin. A first spring biases the sliding surface toward the pin, and a second, weaker spring biases the pin toward the sliding surface. Movement of the actuating member along the longitudinal axis of the drive stud in a selected direction allows the second spring to slide the pin from the engaging to the release positions.

21 Claims, 3 Drawing Sheets

QUICK RELEASE MECHANISM FOR TOOLS SUCH AS SOCKET WRENCHES

CROSS-REFERENCE TO RELATED APPLICATIONS

This application is a continuation-in-part of co-pending U.S. patent application Ser. No. 08/050,514, filed Apr. 20, 1993, which is in turn a continuation-in-part of U.S. patent application Ser. No. 07/959,215, filed Oct. 9, 1992, now U.S. Pat. 5,233,892. The entire contents of these related patent applications are hereby incorporated by reference.

BACKGROUND OF THE INVENTION

This invention relates to torque transmitting tools of the type having a drive stud shaped to receive and release a tool attachment, and in particular to an improved quick release mechanism for securing and releasing a tool attachment to and releasing it from the drive stud.

My previous U.S. Pat. No. 4,848,196 discloses several quick release mechanisms for securing tool attachments such as sockets to torque transmitting tools such as wrenches. In these mechanisms the tool includes a drive stud which defines a diagonally oriented opening, and a locking pin is positioned within the opening to move in the opening. In its engaging position, the lower end of the locking pin engages a recess in the socket to lock the socket positively in place on the drive stud. When the operator moves the pin in the opening, the lower end of the pin is moved out of contact with the socket, and the socket is released from the drive stud.

In the mechanism shown in FIGS. 1 through 5 of U.S. Pat. No. 4,848,196, the locking pin is held in place by an extension spring which surrounds the shaft of the drive stud. In the version shown in FIGS. 6 and 7, the extension spring is covered by a protective sleeve 70 that includes flanges 74, 76.

SUMMARY OF THE INVENTION

It is an object of this invention to provide an improved quick release mechanism which is simple in construction; which requires only a few, easily manufactured parts; which is rugged and reliable in use; which automatically accommodates various sockets, including those with and without recesses designed to receive a detent; which substantially eliminates any precise alignment requirements; which is readily cleaned; which presents a minimum of snagging surfaces; and which is low in profile.

This invention represents an improvement in a quick release mechanism for a drive stud comprising an out-of-round drive portion and an adjacent portion, wherein the out-of-round portion is shaped to fit within a tool attachment to apply torque to the tool attachment. A passageway extends obliquely with respect to a longitudinal axis defined by the drive stud between a first end at the drive portion and a second end at the adjacent portion. The mechanism comprises a locking element slidably received in the passageway to slide between a tool attachment engaging position and a tool attachment release position.

According to a first aspect of this invention, a releasing spring is coupled to the locking element to bias the locking element to the tool attachment release position. An actuator is movably mounted on the drive stud adjacent the second end for movement between a first position, in which the actuator holds the locking element in the tool attachment engaging position, and a second position, in which the actuator allows the releasing spring to move the locking element to the tool attachment release position. An engaging spring is coupled to the actuator to bias the actuator to the first position and to compress the releasing spring.

According to a second aspect of this invention, an actuator is movably mounted on the drive stud adjacent the second end for movement between a first position, in which the actuator holds the locking element in the tool attachment engaging position, and a second position, in which the actuator allows the locking element to move to the tool attachment release position. An engaging spring is coupled to the actuator to bias the actuator to the first position. The actuator comprises a sliding surface positioned to contact the locking element such that the locking element slides along the sliding surface as the actuator moves between the first and second positions. The sliding surface is oriented obliquely to the longitudinal axis defined by the drive stud, and it is oriented to face toward the passageway to push the locking element toward the engaging position.

The preferred embodiment described below is simple, compact, rugged and inexpensive to manufacture.

BRIEF DESCRIPTION OF THE DRAWINGS

FIG. 5 illustrates the fact that when one pulls downwardly on the socket while so locked, the pin firmly resists downward movement of the socket and prevents removal of the socket.

DETAILED DESCRIPTION OF THE PRESENTLY PREFERRED EMBODIMENTS

Figure 1:
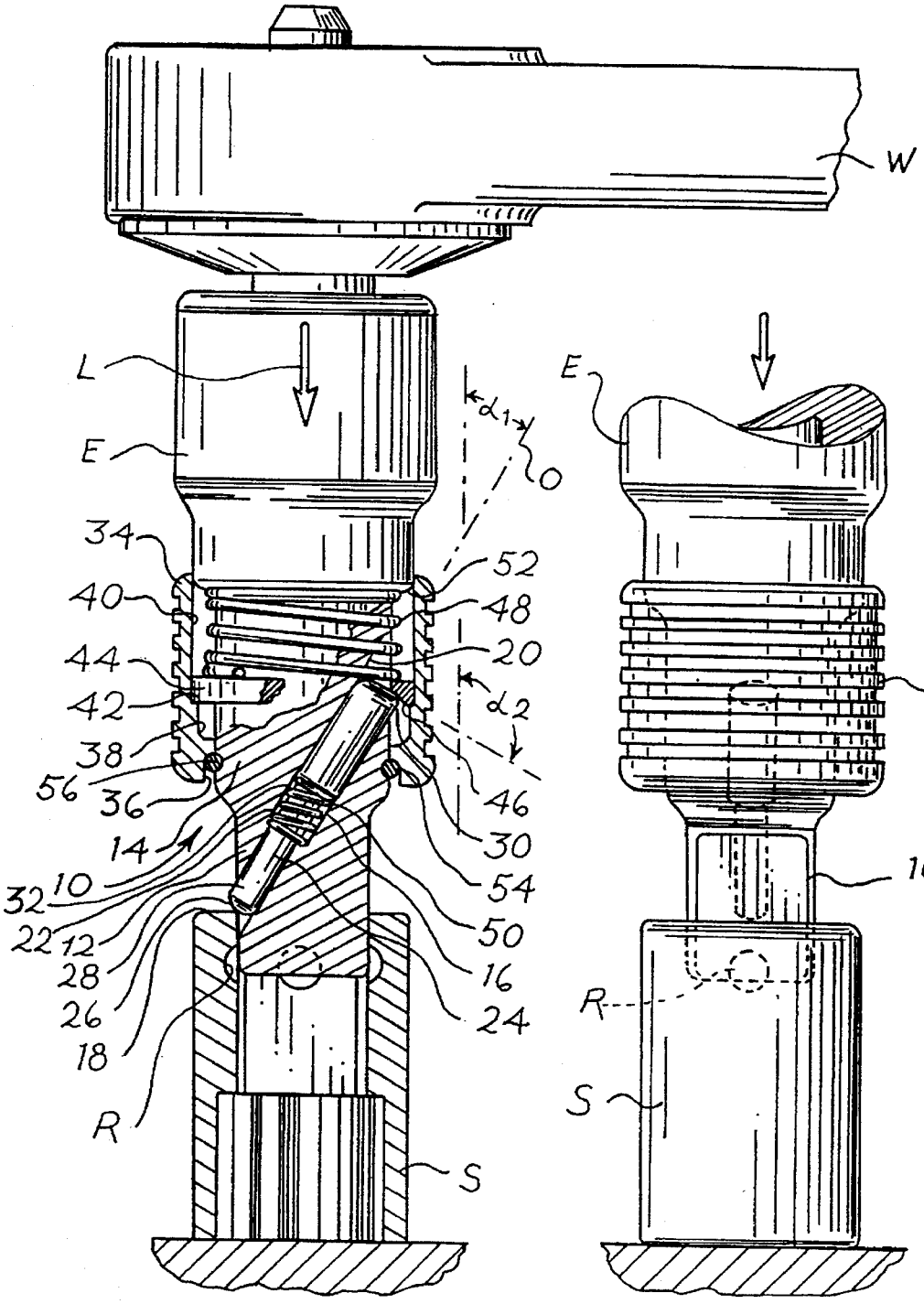
FIG. 1 is a side elevational view partially in cross section of a rachet socket wrench, an extension bar and a socket disposed for attachment to the lower end of the extension bar and showing a presently preferred embodiment of the quick release mechanism of this invention.
Figure 2:
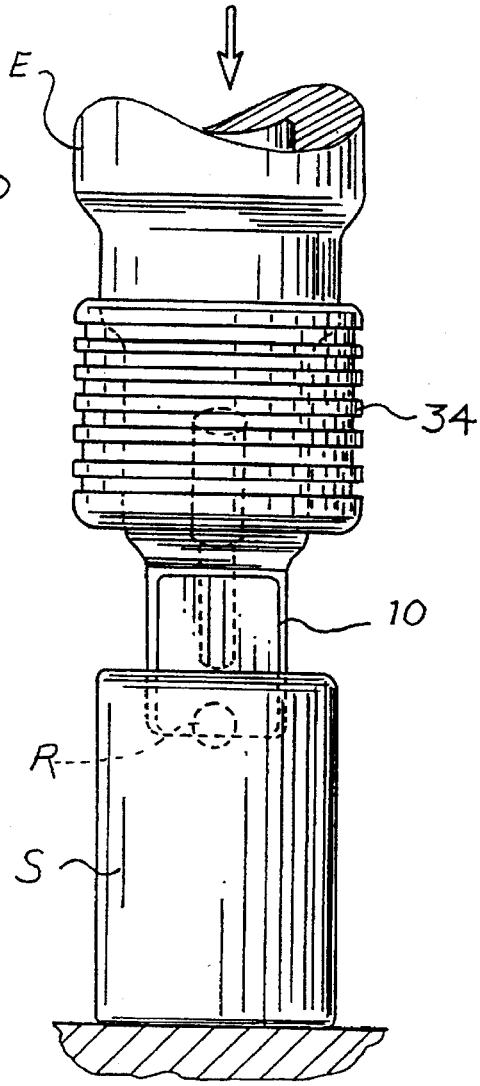
FIG. 2 is a fragmentary side elevational view taken along line 2—2 of FIG. 1.

Turning now to the drawings, FIG. 1 shows a side elevational view of a tool which in this preferred embodiment includes an extension bar E. As shown in FIG. 1, extension bar E is designed to be mounted on a wrench W and to fit into and transmit torque to a socket S. The extension bar E terminates at its lower end in a drive stud 10 having a lower portion 12 and an upper portion 14. The lower portion 12 is constructed for insertion into the socket S, and defines an out-of-round cross section. Typically, the lower portion 12 has a square, hexagonal or other non-circular shape in horizontal cross section. The upper portion 14 will often define a circular cross section, though this is not required.

As shown in FIG. 1, the drive stud 10 is configured to define a diagonally positioned opening or passageway 16 having a lower end 18 and a upper end 20. The lower end 18 is positioned in the lower portion 12 of the drive stud 10, and the upper end 20 is positioned in the upper portion 14 of the drive stud 10. The opening 16 has a larger diameter adjacent the upper end 20 than the lower end 18, and the opening 16 defines a transverse step 22 between the larger and smaller diameter portions of the opening 16.

It may be preferable in some embodiments to provide the opening 16 with a constant diameter, and to define the step 22 in some other manner, as for example with a plug of the type shown in FIG. 20 of my previous U.S. Pat. No. 4,848,196.

As shown in FIG. 1, a locking element such as a pin 24 is slidably positioned in the opening 16. This pin 24 defines a lower end 26 shaped to engage the socket S and an upper end 30. The lower end 26 of the pin 24 may be formed in any suitable shape, for example it can be conventionally rounded, or it may alternately be provided with a step as shown in my previous U.S. Pat. No. 4,848,196. Though illustrated as a pin 24, the locking element may take various shapes, including irregular and elongated shapes. The purpose of the locking element is to hold the tool attachment in place on the drive stud during normal use, for example when pulled by a user, and the term "locking" does not imply locking the tool attachment in place against all conceivable forces tending to dislodge the tool attachment. If desired, the pin 24 may be provided with an out-of-round cross section and the opening 16 may define a complementary shape such that a preferred rotational position of the pin 24 in the opening 16 is automatically obtained.

The pin 24 defines a reduced diameter portion 28 adjacent the lower end 26. A shoulder 32 is formed at an intermediate portion of the pin 24 adjacent one edge of the reduced diameter portion 28.

Also as shown in FIG. 1, an actuator such as a collar 34 is positioned around the upper portion 14 of the drive stud 10. The collar 34 is annular in shape, and the interior surface of the collar 34 defines first, second and third recesses 36, 38, 40. The transition between the second and third recesses 38, 40 forms a shoulder 42. A ring 44 is positioned within the collar 34 in the third recess 40, between the collar 34 and the drive stud 10. This ring 44 may be free to rotate and to translate along the length of the collar 34, and the ring 44 defines a sliding surface 46. The sliding surface 46 faces the pin 24 and may be generally frusto-conical in shape.

Though the actuating member is shown as a collar 34 that slides along the longitudinal axis 40, an alternate embodiment of the actuating member may be formed as a slide that does not encircle the drive stud 10. The ring 44 may be considered as a part of the actuator, and the sliding surface 46 may be formed as an integral part of the collar 34 if desired.

As best shown in FIG. 1, the drive stud 10 defines a longitudinal axis L and the collar 34 is guided to move along the longitudinal axis L. The opening 16 defines an opening axis O which is oriented at a first non-zero acute angle $\alpha_1$ with respect to the longitudinal axis L. The sliding surface 46 may be oriented at a second non-zero angle $\alpha_2$ with respect to the longitudinal axis L. The angles $\alpha_1$ and $\alpha_2$ preferably differ by 90°. With this arrangement, the sliding surface 46 is oriented generally parallel to the upper end 30 of the pin 24 and generally perpendicular to the pin 24 at the point of contact between these two elements.

Figure 6:
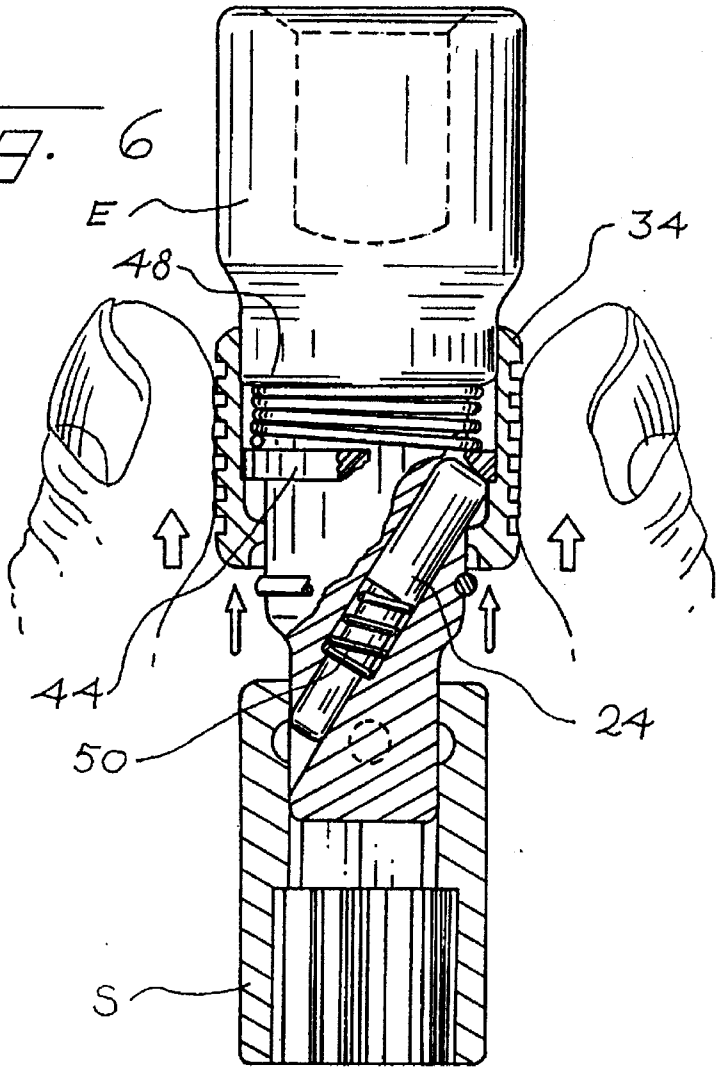
FIG. 6 is a view similar to FIG. 4 but showing that the operator can effect a quick release of the socket by manually lifting the collar surrounding the drive stud and allowing the socket to drop from the drive study by force of gravity.

A releasing spring 50 biases the pin 24 to the release position shown in FIG. 6. As shown, the releasing spring 50 is a compression coil spring which bears between the step 22 and the shoulder 32. In alternate embodiments this spring may be implemented in other forms, placed in other positions, or integrated with other components. For example, the spring 50 may be embodied as a leaf spring, or it may be integrated into the ring. Furthermore, if a coil spring is used, it may be employed as either a compression or an extension spring with suitable alterations to the design of FIG. 1.

Figure 4:
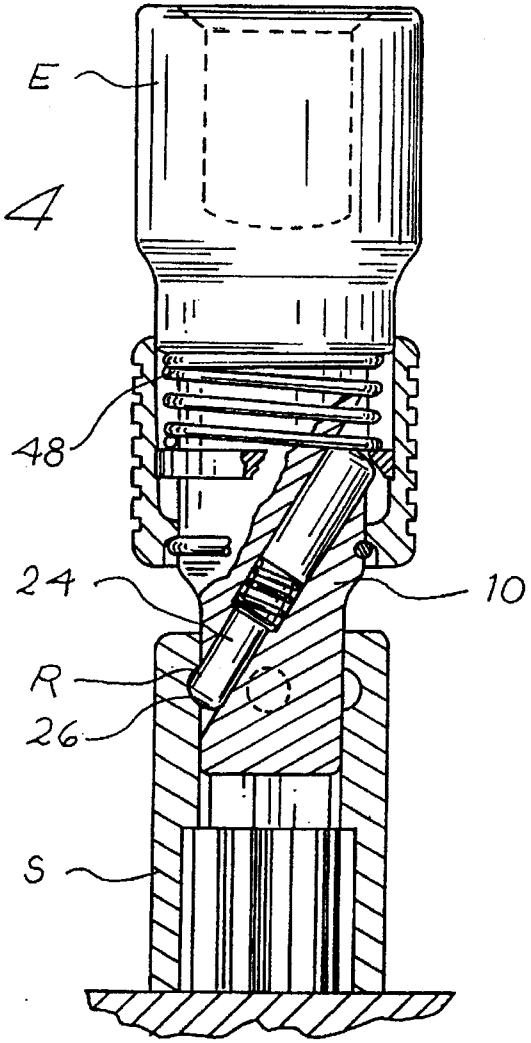
FIG. 4 is a view similar to FIG. 3 showing the drive stud of the extension bar moved downwardly into its final position in the socket with the locking pin with its lower end projecting into the recess provided in the inner surface of the socket.

An engaging spring 48 such as the illustrated coil spring biases the ring 44 and the collar 34 downwardly as shown in FIG. 4. Resilient forces supplied by the engaging spring 48 tend to push the pin 24 to the engaging position shown in FIG. 4. The engaging spring 48 reacts at its upper end against a drive stud shoulder 52, and at its lower end against the ring 44. In this preferred embodiment the engaging spring 48 provides a greater spring force than the releasing spring 50 such that the engaging spring 48 compresses the releasing spring 50 and holds the pin 24 in the engaging position in the absence of external forces on the collar 34.

The collar 34 is held in place on the drive stud 10 by a retaining ring 56 that can be a spring ring received in a recess 54 formed in the drive stud 10. The retaining ring 56 is sized to fit within the first recess 36 when the collar 34 is in the position shown in FIG. 1. Though a retaining ring is preferred, other approaches can be used to hold the collar in the assembled position shown in the drawings. For example, an upset may be formed on the drive stud or the collar to hold the collar in place while allowing axial sliding movement. Other means such as a pin may be used, in which case the recess 36 is not needed.

The operation of the quick release mechanism described above will be apparent from FIGS. 1 through 6. As shown in FIG. 1, when the lower portion 12 of the drive stud 10 is brought into alignment with the socket S, the lower end 26 of the locking pin 24 bears on the socket S.

Figure 3:
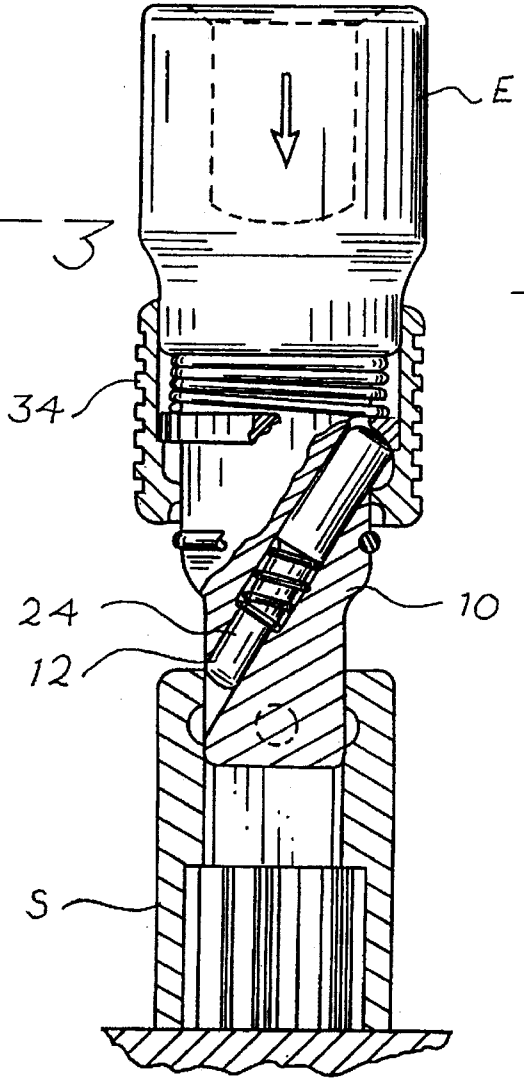
FIG. 3 is a fragmentary side elevational view of the extension bar and the associated socket of FIG. 1 but showing the drive stud of the extension bar partially moved downwardly into the socket and with the locking pin cammed upwardly to allow further downward movement of the drive stud.

As shown in FIG. 3, further downward movement of the drive stud 10 moves the pin 24 inwardly in the opening 16, thereby allowing the lower portion 12 to move within the socket S. This can be done without manipulating the collar 34 in any way.

As shown in FIG. 4, when the drive stud 10 is fully seated in the socket S, the spring 48 biases the locking pin 24 toward the engaging position, in which the lower end 26 of the locking pin 24 engages the recess R in the socket S. The pin 24 will provide at least frictional engagement, even with a socket S which does not include a recess R.

Figure 5:
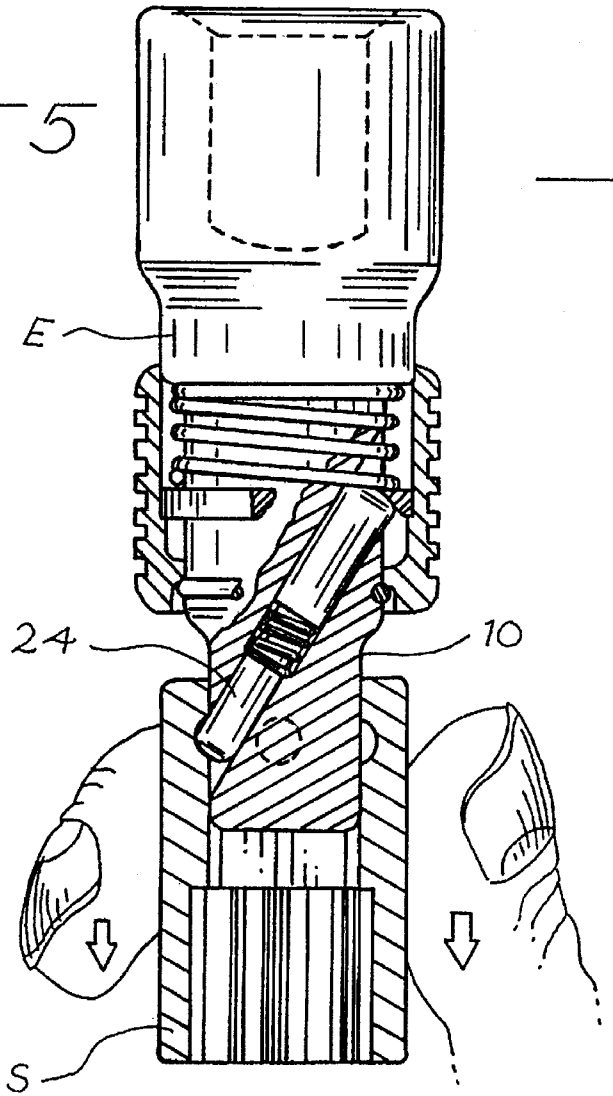
FIG. 5 is a view similar to FIG. 4 showing the relationship of the parts when the socket is positively latched on the drive stud of the extension bar.

As shown in FIG. 5, downward forces on the socket S are not effective to move the locking pin 24 out of the recess R, and the socket S is positively held in place on the drive stud 10.

As shown in FIG. 6, the collar 34 can be raised to release the socket S. As the collar 34 is raised, the ring 44 is moved upwardly, and the engaging spring 48 is compressed. The releasing spring 50 then moves the pin 24 to the release position of FIG. 6. When the locking pin 24 reaches the release position the socket S is free to fall from the drive stud 10 under the force of gravity.

The pin 24 is not subjected to any significant side loading, because the collar 34 and the ring 44 are both free to rotate freely on the drive stud 10. Because the ring 44 is slidable with respect to the collar 44, the pin 44 can move the ring 44 upwardly to compress the engaging spring 48, without moving the collar 34.

In other embodiments, the sliding surface 46 may have other shapes, such as a discontinuous surface or a plurality of surfaces, to allow relative movement between sliding surface 46 and pin 24 without binding. Thus, it is contemplated to employ all combinations of shapes for the sliding surface 46 and the pin 24 which allow them to cooperate with each other so as to move relative to each other without binding.

In alternate embodiments the sliding surface 46 can be oriented at other angles as desired. The orientation of the sliding surface 46 with respect to the longitudinal axis L can be selected to provide the desired relationship between the stroke of the collar 34 and the stroke of the pin 24.

This invention can be adapted for use with the widest range of torque transmitting tools, including hand tools, power tools and impact tools. Simply by way of illustration, this invention can be used with socket wrenches, including those having ratchets, T-bar wrenches, and speeder wrenches, all as described and shown in U.S. Pat. No. 4,848,196. Furthermore, this invention is not limited to sockets of the type shown, but can be used with a wide range of tool attachments, including sockets or tool attachments with recesses R of various sizes, and even on sockets without a recess of any type.

Of course, the quick release mechanism of this invention can be used in any physical orientation, and the terms upper, lower and the like have been used with reference to the orientation shown in the drawings. Furthermore, the terms "engaging position" and "release position" are each intended to encompass multiple positions within a selected range. For example, in the embodiment of FIG. 1 the exact position of the engaging position will vary with the depth of the recess R in the socket S, and the exact position of the release position may vary with a variety of factors, including the extent to which the actuating member is moved, and the shape (square or other) of the female opening in the socket S or other tool attachment.

As suggested above, the present invention can be implemented in many ways, and this invention is not limited to the specific embodiments shown in the drawings. However, in order to define the presently preferred embodiment of this invention the following details of construction are provided. Of course, these details are in no way intended to limit the scope of this invention.

By way of example, the pin 24 may be formed of a material such as a steel of moderate to mild temper, and the collar 34, the ring 44, and the retainer 56 may be formed of any suitable material such as brass, steel, other alloy or plastic. The angle $\alpha 1$ may range from about 30° to about 45° and the angle $\alpha 2$ may range from about 120° to about 135°, respectively.

From the foregoing description it should be apparent that the objects set out initially above have been achieved. In particular, the mechanism shown in the drawings is low profile with respect to the circumference of the extension bar E. The disclosed mechanism is simple to manufacture and assemble, and it requires relatively few parts. It is rugged in operation, and it automatically engages a socket as described above. Because of its design, the mechanism will accommodate various types of sockets. In the illustrated embodiment, the collar 34 may be gripped at any point on its circumference, and does not require the operator to use a preferred angular orientation of the tool.

In some alternate embodiments, the locking element may be configured to require a positive action on the part of the operator to retract the locking element as the drive stud is moved into the socket. Certain of these embodiments may require recesses in the sockets as described above to provide all of the functional advantages described.

In the preferred embodiment described above the difference between the first and second angles $\alpha 1$ and $\alpha 2$ is approximately 90°. This minimizes skew forces applied to the pin 24 and minimizes any tendency of the pin 24 to bind in the opening 16. However, if friction between the pin 24 and the walls of the opening 16 is sufficiently low, the sliding surface 46 may be positioned at a skew angle with respect to the pin 24, rather than the transverse angle illustrated.

It is intended that the foregoing detailed description be regarded as illustrative rather than limiting, and that it be understood that it is the following claims, including all equivalents, which are intended to define the scope of this invention.

We claim:

1. In a quick-release mechanism for a tool comprising a drive stud, said drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment and said mechanism comprising a locking element slideably received in the passageway to slide between a tool attachment engaging position and a tool attachment release position; the improvement comprising:

a releasing spring biasing the locking element toward the tool attachment releasing position;

an actuator movably mounted on the drive stud adjacent the second end for movement between a first position, in which the actuator holds the locking element in the tool attachment engaging position, and a second position, in which the actuator allows the releasing spring to move the locking element to the tool attachment release position.

2. In a quick-release mechanism for a tool comprising a drive stud, said drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment and said mechanism comprising a locking element slideably received in the passageway to slide between a tool attachment engaging position and a tool attachment release position; the improvement comprising:

an actuator movably mounted on the drive stud adjacent the second end for movement between a first position, in which the actuator holds the locking element in the tool attachment engaging position, and a second position, in which the actuator allows the locking element to move to the tool attachment release position;

an engaging spring coupled to the actuator to bias the actuator to the first position;

said actuator comprising a sliding surface positioned to contact the locking element such that the locking element slides along the surface as the actuator moves between the first and second positions;

said sliding surface oriented to push the locking element toward the engaging position;

said actuator comprising a ring and a collar, wherein the sliding surface is formed on the ring, and wherein the ring is rotatably received in the collar.

3. The invention of claim 1 wherein the actuator comprises a sliding surface positioned to contact the locking element adjacent the second end of the passageway.

4. The invention of claim 1 further comprising an engaging spring biasing the actuator to the first position, compressing the releasing spring.

5. The invention of claim 3 wherein the actuator comprises a ring and a collar, wherein the sliding surface is formed on the ring, and wherein the ring is rotatably received in the collar.

6. The invention of claim 5 or 2 wherein the ring is slidably received in the collar.

7. The invention of claim 3 wherein the locking element slides along the sliding surface as the actuator moves between the first and second positions.

8. The invention of claim 2 or 3 wherein the sliding surface is generally frusto-conical in shape and inwardly facing.

9. The invention of claim 4 wherein the releasing spring biases the locking element into contact with the actuator, and wherein the engaging spring biases the actuator into contact with the locking element.

10. The invention of claim 9 wherein the releasing spring comprises a compression coil spring disposed around the locking element.

11. The invention of claim 2 or 4 wherein the engaging spring comprises a compression coil spring disposed around the drive stud, between the drive stud and the actuator.

12. The invention of claim 2 or 3 wherein the sliding surface is substantially transverse to the locking element where the sliding surface contacts the locking element.

13. The invention of claim 6 wherein the engaging spring bears directly on the ring.

14. The invention of claim 2 wherein the actuator comprises a first element that forms the sliding surface, and wherein the engaging spring bears directly on the first element.

15. The invention of claim 2 wherein the passageway and the sliding surface are oriented such that the engaging spring resiliently biases the locking element to the tool attachment engaging position when the actuator is in the first position.

16. In a quick-release mechanism for a tool comprising a drive stud, said drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment and said mechanism comprising a locking element slideably received in the passageway to slide between a tool attachment engaging position and a tool attachment release position; the improvement comprising:

an actuator movably mounted on the drive stud adjacent the second end for movement between a first position, in which the actuator holds the locking element in the tool attachment engaging position, and a second position, in which the actuator allows the locking element to move to the tool attachment release position;

an engaging spring coupled to the actuator to bias the actuator to the first position;

said actuator comprising a sliding surface positioned to contact the locking element such that the locking element slides along the surface as the actuator moves between the first and second positions;

said sliding surface oriented to push the locking element toward the engaging position;

wherein the actuator comprises an element that forms the sliding surface positioned to contact the locking element adjacent the second end of the passageway, and wherein the engaging spring bears directly on the element.

17. In a quick-release mechanism for a tool comprising a drive stud, said drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment and said mechanism comprising a locking element slideably received in the passageway to slide between a tool attachment engaging position and a tool attachment release position; the improvement comprising:

an actuator movably mounted on the drive stud adjacent the second end for movement between a first position, in which the actuator holds the locking element in the tool attachment engaging position, and a second position, in which the actuator allows the locking element to move to the tool attachment release position;

an engaging spring coupled to the actuator to bias the actuator to the first position;

said actuator comprising a sliding surface positioned to contact the locking element such that the locking element slides along the surface as the actuator moves between the first and second positions;

said sliding surface oriented to push the locking element toward the engaging position;

wherein the actuator comprises a first element that forms the sliding surface positioned to contact the locking element adjacent the second end of the passageway and a second element that engages the first element, and wherein the first element is mounted on the drive stud to slide along the longitudinal axis with respect to the second element.

18. In a quick-release mechanism for a tool comprising a drive stud, said drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment and said mechanism comprising a locking element slideably received in the passageway to slide between a tool attachment engaging position and a tool attachment release position; the improvement comprising:

an actuator movably mounted on the drive stud adjacent the second end for movement between a first position, in which the actuator holds the locking element in the tool attachment engaging position, and a second position, in which the actuator allows the locking element to move to the tool attachment release position;

an engaging spring coupled to the actuator to bias the actuator to the first position;

said actuator comprising a sliding surface positioned to contact the locking element such that the locking element slides along the surface as the actuator moves between the first and second positions;

said sliding surface oriented to push the locking element toward the engaging position;

a releasing spring biasing the locking element toward the tool attachment releasing position.

19. In a quick-release mechanism for a tool comprising a drive stud, said drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment and said mechanism comprising a locking element slideably received in the passageway to slide between a tool attachment engaging position and a tool attachment release position; the improvement comprising:

an actuator movably mounted on the drive stud adjacent the second end for movement between a first position, in which the actuator holds the locking element in the tool attachment engaging position, and a second position, in which the actuator allows the locking element to move to the tool attachment release position;

said actuator comprising a sliding surface positioned to contact the locking element such that the locking element slides along the surface as the actuator moves between the first and second positions;

said sliding surface oriented to push the locking element toward the engaging position;

said sliding surface oriented non-parallel to the longitudinal axis such that incremental movement of the actuator away from the first position allows incremental movement of the locking element away from the tool attachment engaging position;

wherein the actuator comprises an element that forms the sliding surface positioned to contact the locking element adjacent the second end of the passageway, and wherein the engaging spring bears directly on the element.

20. In a quick-release mechanism for a tool comprising a drive stud, said drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment and said mechanism comprising a locking element slideably received in the passageway to slide between a tool attachment engaging position and a tool attachment release position; the improvement comprising:

an actuator movably mounted on the drive stud adjacent the second end for movement between a first position, in which the actuator holds the locking element in the tool attachment engaging position, and a second position, in which the actuator allows the locking element to move to the tool attachment release position;

said actuator comprising a sliding surface positioned to contact the locking element such that the locking element slides along the surface as the actuator moves between the first and second positions;

said sliding surface oriented to push the locking element toward the engaging position;

said sliding surface oriented non-parallel to the longitudinal axis such that incremental movement of the actuator away from the first position allows incremental movement of the locking element away from the tool attachment engaging position;

wherein the actuator comprises a first element that forms the sliding surface positioned to contact the locking element adjacent the second end of the passageway and a second element that engages the first element, and wherein the first element is mounted on the drive stud to slide along the longitudinal axis with respect to the second element.

21. In a quick-release mechanism for a tool comprising a drive stud, said drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment and said mechanism comprising a locking element slideably received in the passageway to slide between a tool attachment engaging position and a tool attachment release position; the improvement comprising:

an actuator movably mounted on the drive stud adjacent the second end for movement between a first position, in which the actuator holds the locking element in the tool attachment engaging position, and a second position, in which the actuator allows the locking element to move to the tool attachment release position;

said actuator comprising a sliding surface positioned to contact the locking element such that the locking element slides along the surface as the actuator moves between the first and second positions;

said sliding surface oriented to push the locking element toward the engaging position;

said sliding surface oriented non-parallel to the longitudinal axis such that incremental movement of the actuator away from the first position allows incremental movement of the locking element away from the tool attachment engaging position;

a releasing spring biasing the locking element toward the tool attachment releasing position.

* * * * *